US008516634B2

(12) United States Patent
Turner et al.

(10) Patent No.: US 8,516,634 B2
(45) **Date of Patent: *Aug. 27, 2013**

(54) BED STRUCTURE WITH A DECK SECTION MOTION CONVERTER

(75) Inventors: Jonathan D Turner, Dillsboro, IN (US); Christian H Reinke, York, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 346 days.

This patent is subject to a terminal disclaimer.

(21) Appl. No.: 12/833,321

(22) Filed: Jul. 9, 2010

(65) Prior Publication Data

US 2012/0005832 A1 Jan. 12, 2012

(51) Int. Cl.
*A47B 71/00* (2006.01)

(52) U.S. Cl.
USPC ..... 5/600; 5/617

(58) Field of Classification Search
USPC ..... 5/613, 616–618, 601, 612; 414/549; 297/377, 383
See application file for complete search history.

(56) References Cited

U.S. PATENT DOCUMENTS

| | | | | |
|---|---|---|---|---|
| 3,302,219 | A * | 2/1967 | Harris | 5/85.1 |
| 3,729,751 | A * | 5/1973 | Kirkman | 5/616 |
| 4,685,159 | A * | 8/1987 | Oetiker | 5/608 |
| 5,404,604 | A * | 4/1995 | Has et al. | 5/617 |
| 5,870,784 | A * | 2/1999 | Elliott | 5/618 |
| 6,578,215 | B1 * | 6/2003 | Heimbrock et al. | 5/617 |
| 6,978,501 | B2 * | 12/2005 | Vrzalik | 5/624 |
| 7,698,761 | B2 | 4/2010 | Neuenswander | |
| 8,042,210 | B2 * | 10/2011 | Clenet | 5/618 |
| 2001/0011394 | A1 * | 8/2001 | Heimbrock et al. | 5/618 |
| 2008/0250562 | A1 * | 10/2008 | Tekulve | 5/613 |
| 2010/0122415 | A1 * | 5/2010 | Turner et al. | 5/618 |

FOREIGN PATENT DOCUMENTS

WO 2012006545 A9 1/2012

OTHER PUBLICATIONS

Written Opinion of the International Searching Authority; Date of Completion of Opinion—Feb. 13, 2012; Mailing Date—Feb. 28, 2012; Authorized Officer—Blaine R. Copenheaver; International Application No. PCT/US2011/043392; International Filing Date Jul. 8, 2011; Applicant—Hill-Rom Services, Inc.

International Search Report; Date of Completion of International Search Report—Feb. 13, 2012; Mailing Date—Feb. 28, 2012; Authorized Officer—Blaine R. Copenheaver; International Application No. PCT/US2011/043392; International Filing Date Jul. 8, 2011; Applicant—Hill-Rom Services, Inc.

(Continued)

*Primary Examiner* — Michael Trettel
*Assistant Examiner* — Richard G Davis
(74) *Attorney, Agent, or Firm* — Kenneth C. Baran

(57) ABSTRACT

A bed structure includes a frame 28, a deck framework 50 moveably connected to the frame, a panel 72 moveably connected to the deck framework, and a motion converter 100. The motion converter translates the panel relative to the deck framework in response to either or both of a) relative translation between the deck framework and the frame, and b) relative rotation of the deck framework and the frame. In one detailed embodiment the motion converter includes a rack 102 secured to the frame, a primary gear 124 meshing with the rack, a panel drive sprocket 170 rotatably mounted on the deck framework coaxially with the primary gear, an idler sprocket 192 rotatably mounted on the deck framework remote from the panel drive sprocket, a slider connected to the panel, and a chain 220 engaged with the panel drive sprocket and the idler and connected to the slider.

26 Claims, 15 Drawing Sheets

(56) References Cited

OTHER PUBLICATIONS

Notification of Transmittal of the International Search Report and The Written Opinon of the International Searching Authority, or the Declaration; International Application No. PCT/US2011/043392; International Filing Date Jul. 8, 2011; Mailing Date—Feb. 28, 2012; Applicant—Hill-Rom Services, Inc.

* cited by examiner

BED STRUCTURE WITH A DECK SECTION MOTION CONVERTER

TECHNICAL FIELD

The subject matter described herein relates to articulable supports, such as hospital beds, and particularly to a support having a deck framework, a deck panel connected to the framework and a motion converter for coordinating a translational motion of the panel with rotation and/or longitudinal translation of the framework.

BACKGROUND

Pending U.S. patent application Ser. No. 12/618,256, filed on Nov. 13, 2009 and entitled "Anthropometrically Governed Occupant Support" describes an articulable support, such as a hospital bed, whose articulation depends at least in part on anthropometric considerations. The contents of application Ser. No. 12/618,256 are incorporated herein by reference. The application discloses a mode of operation in which rotation of a bed upper body section is accompanied by longitudinal translation of the upper body section and "parallel translation" of an upper body deck panel. The application defines parallel translation as translation of the deck panel in a direction parallel to the existing angular orientation of the upper body section.

The teachings of the earlier application are presented in the context of a bed having three actuators for controlling motions of the upper body section. One of these actuators controls the parallel translation. The other two are operated to rotate the upper body section while concurrently translating it longitudinally, to rotate the upper body section without imparting any longitudinal translation, or to translate the upper body section longitudinally without imparting any rotation. Although such a system may be desirable in a prototype or experimental bed to allow maximum flexibility of articulation during testing and development, it is envisioned that beds produced for commercial sale will include fewer actuators for the upper body section. Accordingly, the application also describes a bed with a simplified kinematic configuration having a single upper body section actuator and a dual rack and pinion. In operation the actuator extends or retracts to translate the upper body section longitudinally while changing its angular orientation. At the same time the dual rack and pinion effects the desired parallel translation of the upper body deck panel in response to the translation and orientation of the upper body section.

Notwithstanding the merits of the simplified kinematics and dual rack and pinion described in the earlier application, applicants continue to pursue additional innovations which may lead to improved performance, increased reliability and reduced cost.

SUMMARY

A bed structure includes a frame, a deck framework moveably connected to the frame, a panel moveably connected to the deck framework, and a motion converter. The motion converter translates the panel relative to the deck framework in response to either or both of a) relative translation between the deck framework and the frame, and b) relative rotation of the deck framework and the frame. In one detailed embodiment the motion converter includes a rack secured to the frame, a primary gear meshing with the rack, a panel drive sprocket rotatably mounted on the deck framework coaxially with the primary gear, an idler sprocket rotatably mounted on the deck framework remote from the panel drive sprocket, a slider connected to the panel, and a chain engaged with the panel drive sprocket and the idler and connected to the slider.

BRIEF DESCRIPTION OF THE DRAWINGS

The foregoing and other features of the occupant support described herein will become more apparent from the following detailed description and the accompanying drawings in which.

DETAILED DESCRIPTION

Figure 1:
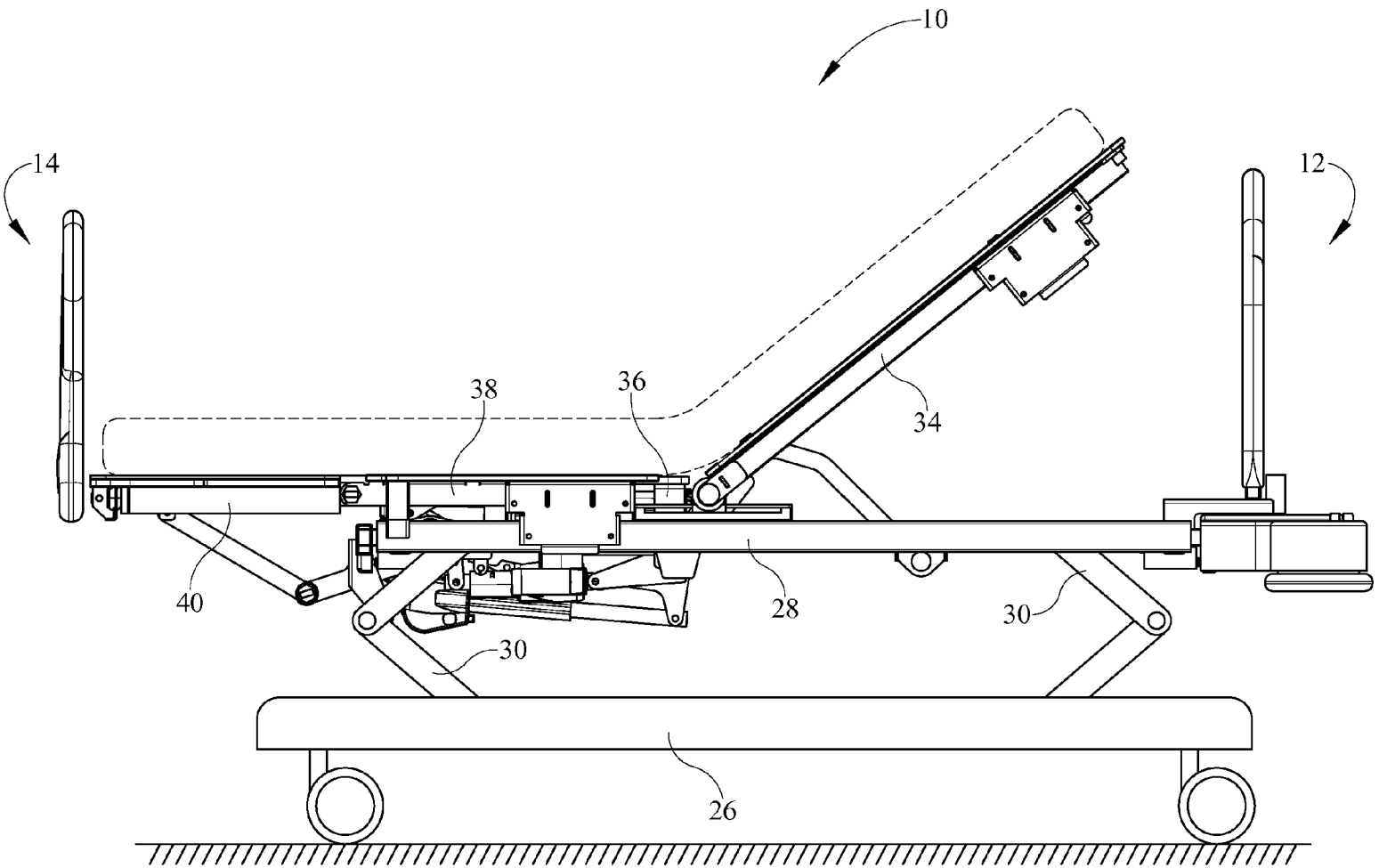
FIG. 1 is a schematic, side elevation view of a bed of the type used in hospitals and other health care facilities.
Figure 2:
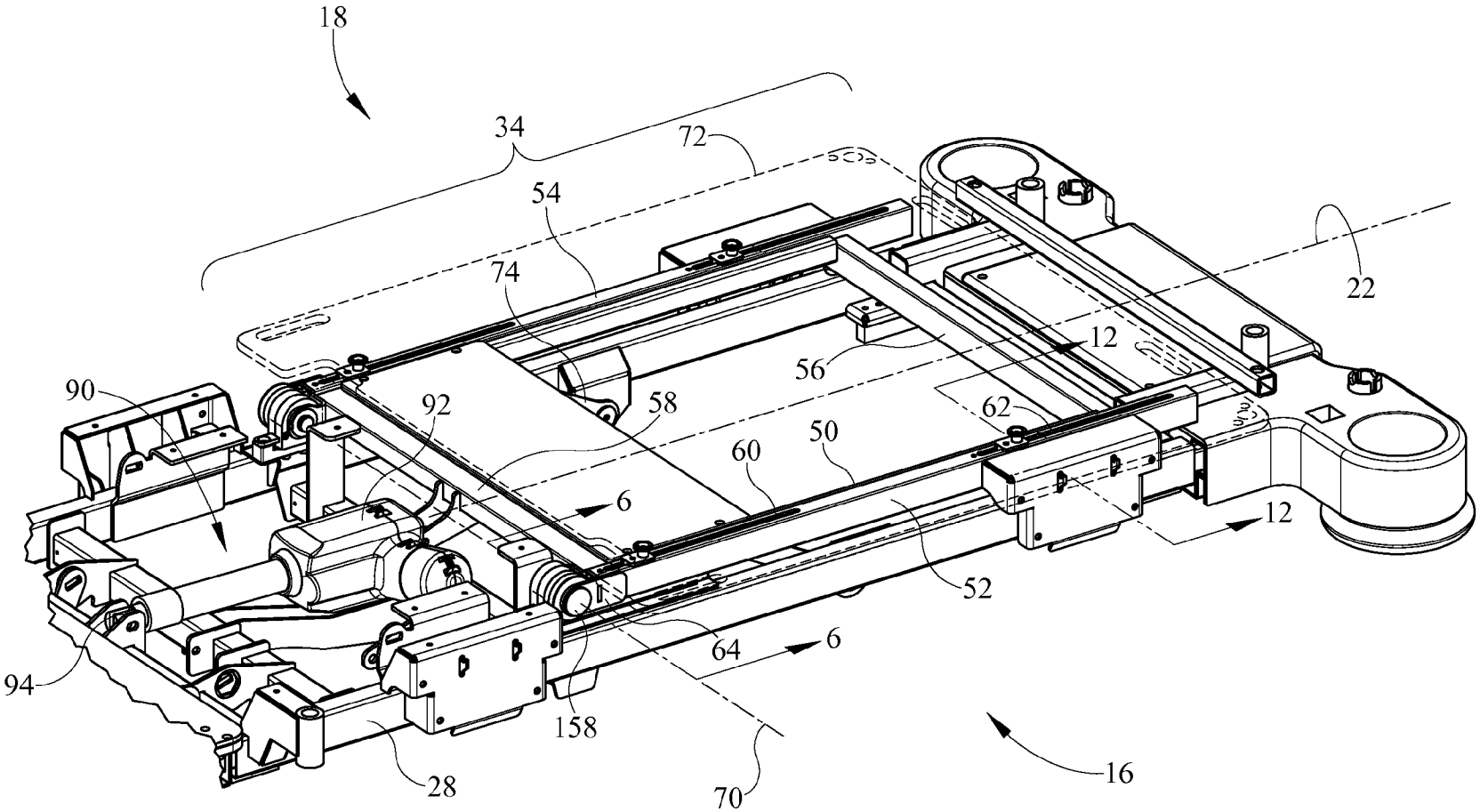
FIG. 2 is a perspective views of a bed structure as described herein with a frame and an upper body deck section, the deck section being shown at a horizontal angular orientation relative to the frame.
Figure 3:
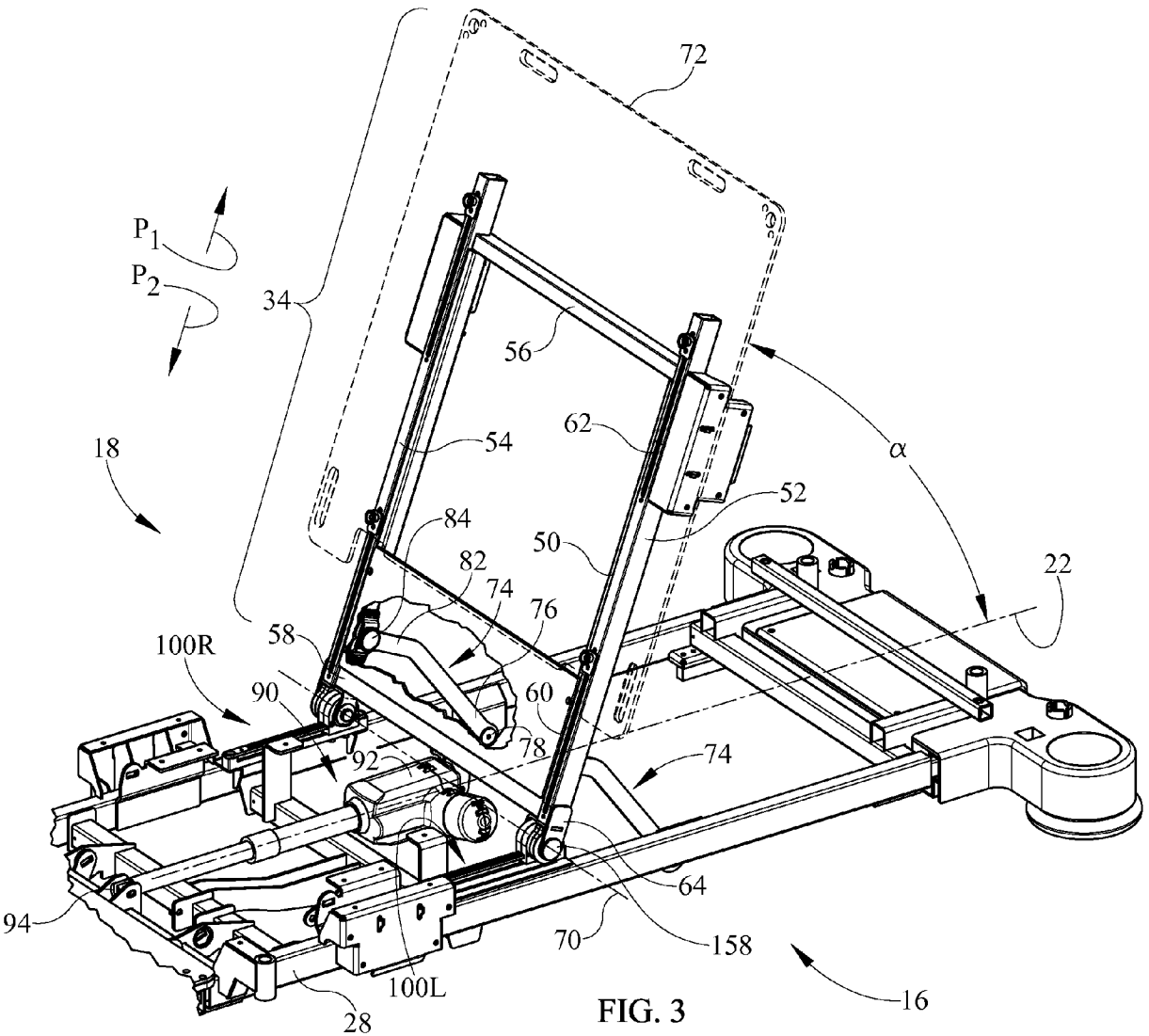
FIG. 3 is a view similar to that of FIG. 2 but with the deck section at an angular orientation of about 65 degrees relative to the frame.
Figure 4:
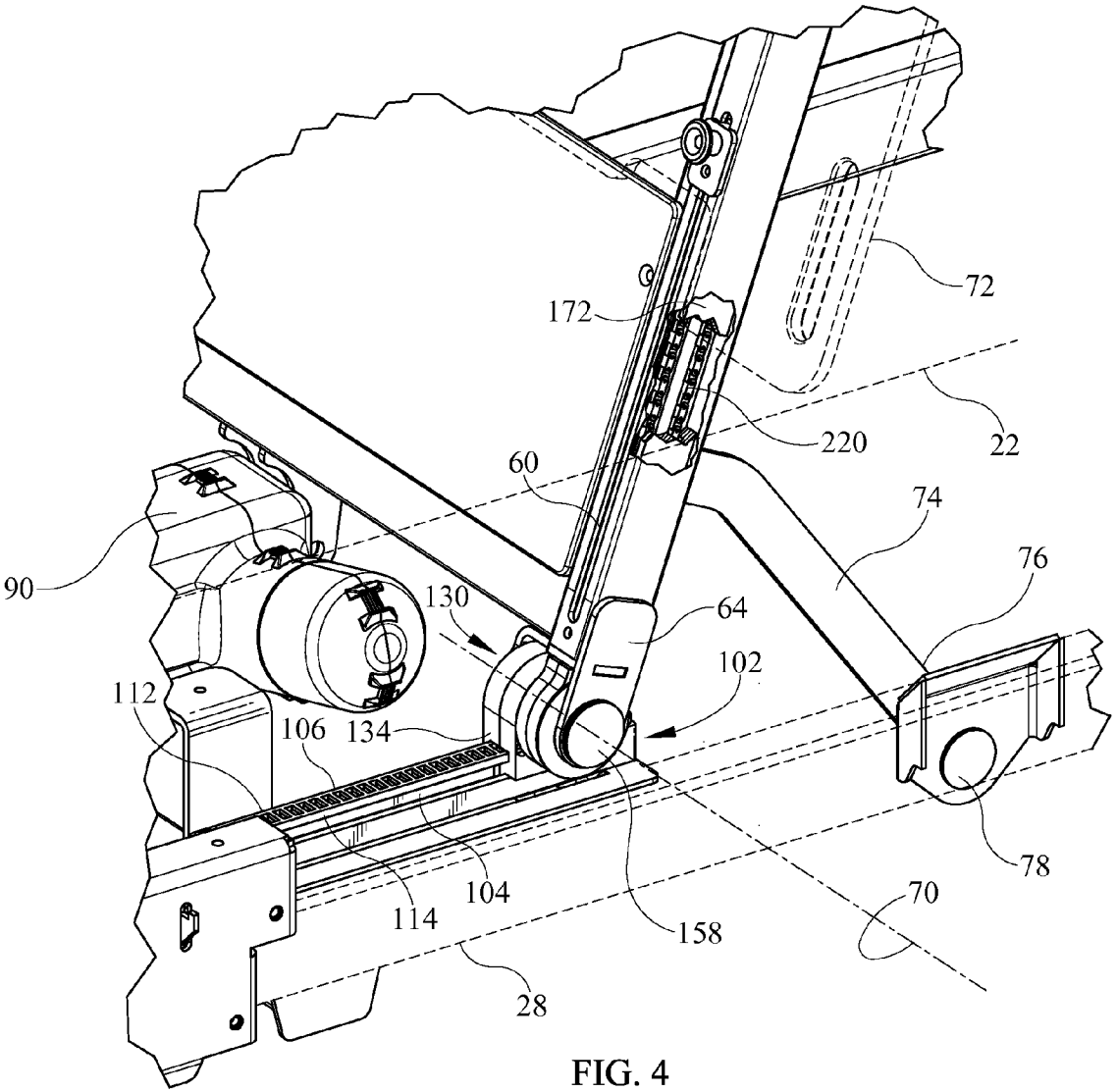
FIG. 4 is a closer view of a portion of FIG. 3 showing, among other things, a gear rack, a split gear housing positioned at one end of the gear rack, and the lower extremity of the deck section and also having part of a deck section rail broken away to reveal a chain and a chain housing inside the rail.
Figure 5:
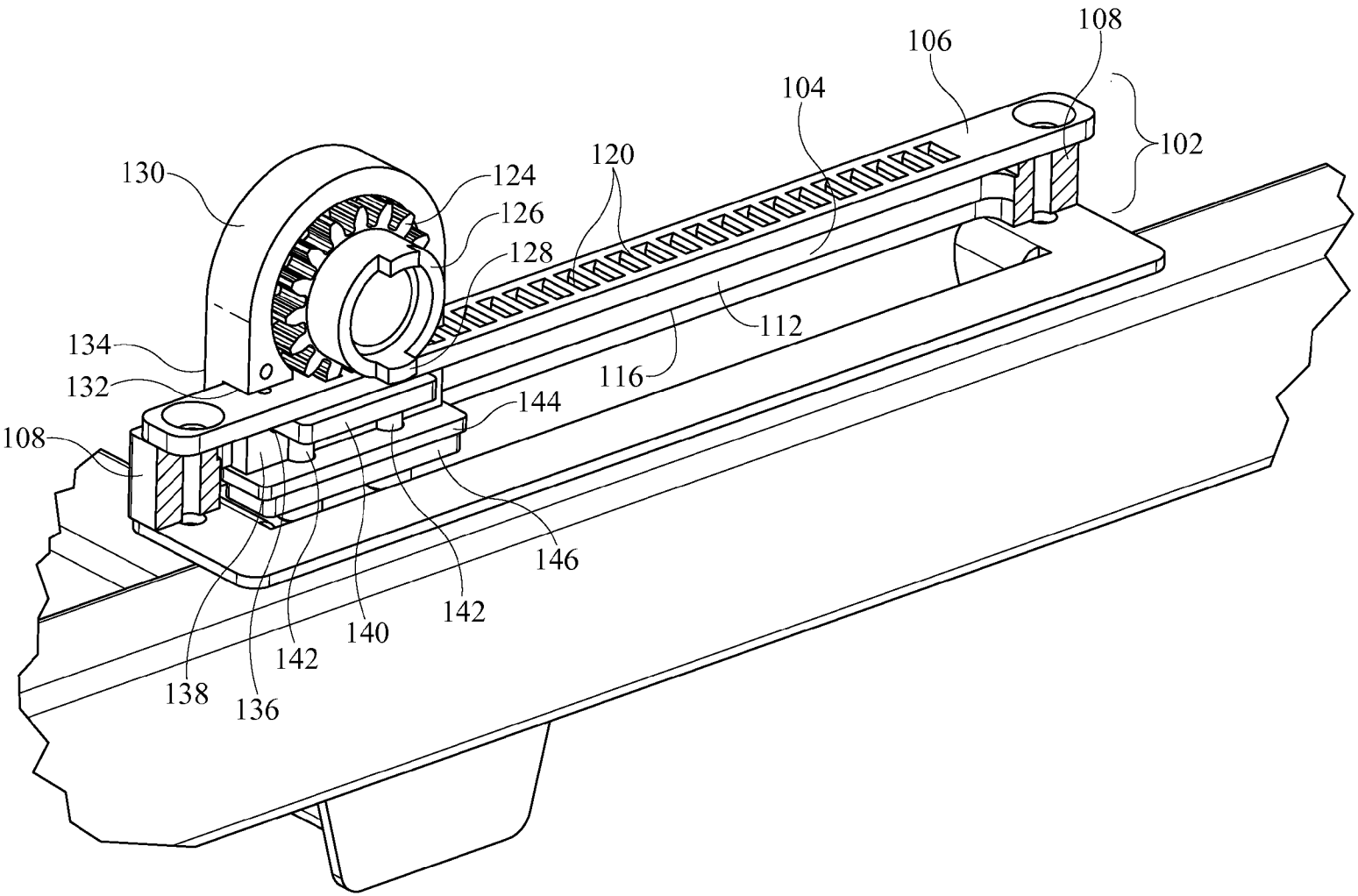
FIG. 5 is a view of the gear rack seen in FIG. 4 but with a slide rail component of the gear rack broken away, with the gear housing at the other end of the gear rack and with certain elements, such as the deck section and one side of the split gear housing, removed.
Figure 6:
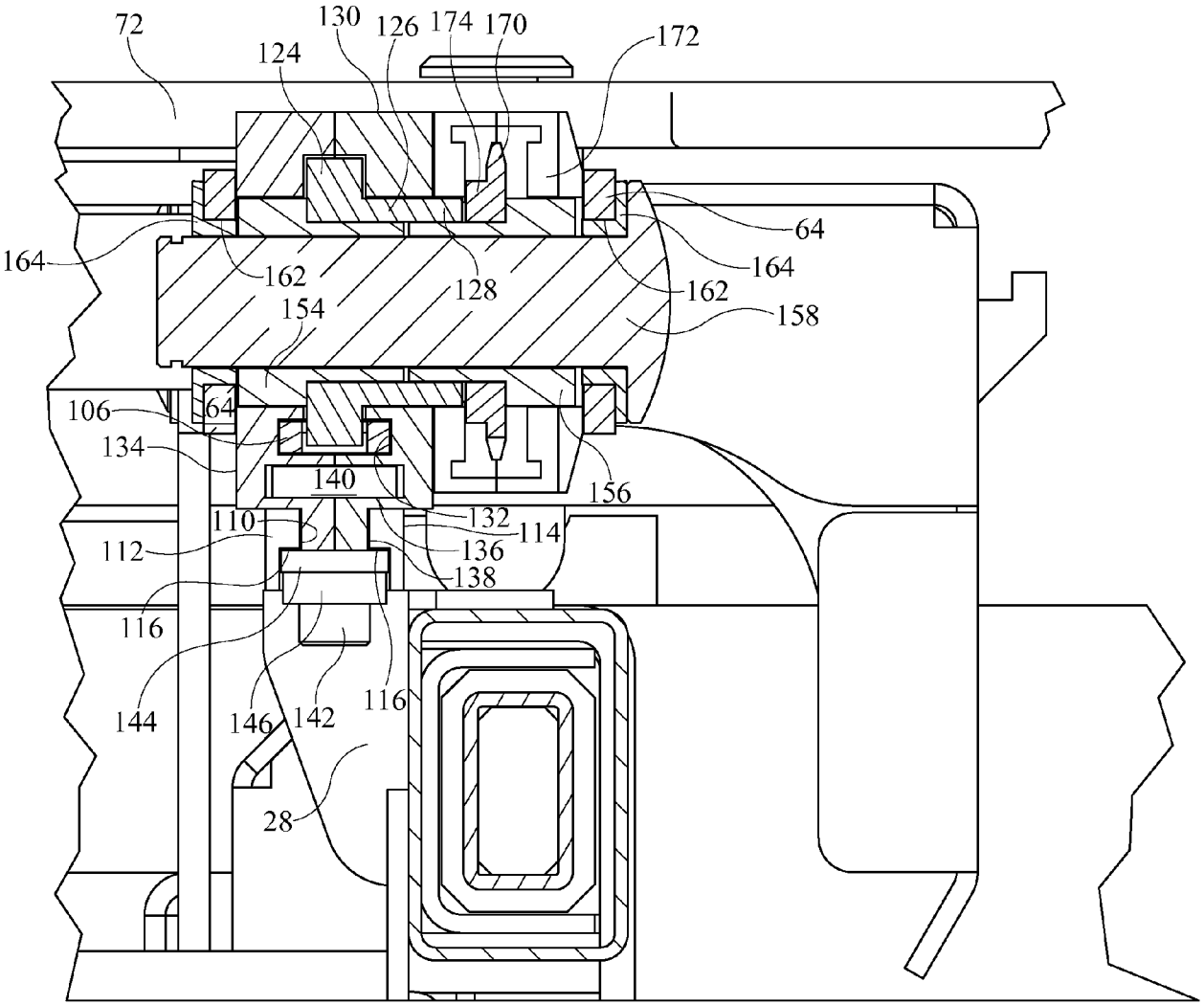
FIG. 6 is a cross sectional view taken in direction 6-6 of FIG. 2.
Figure 7:
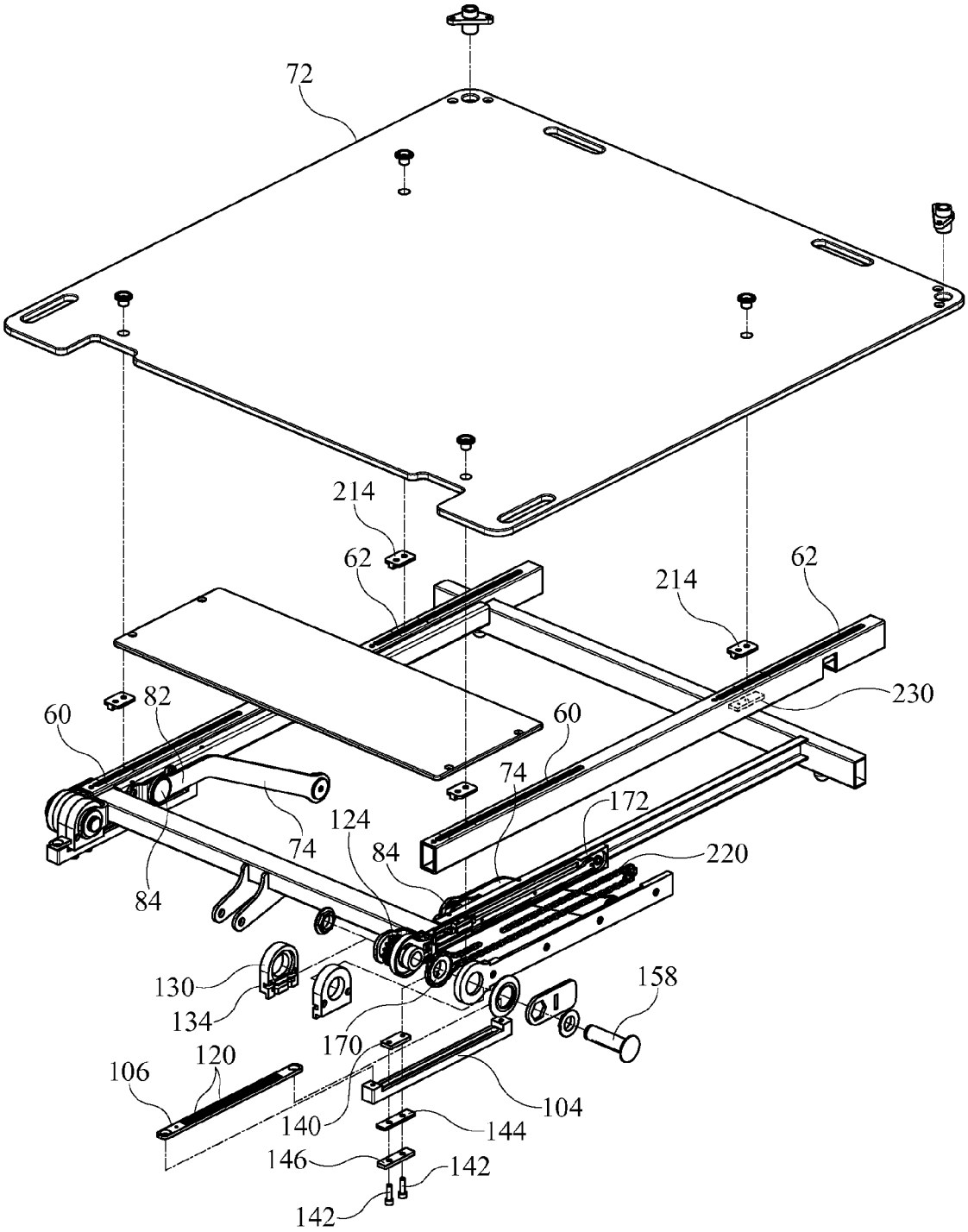
FIGS. 7 and 8 are exploded views showing components of the bed structure.
Figure 8:
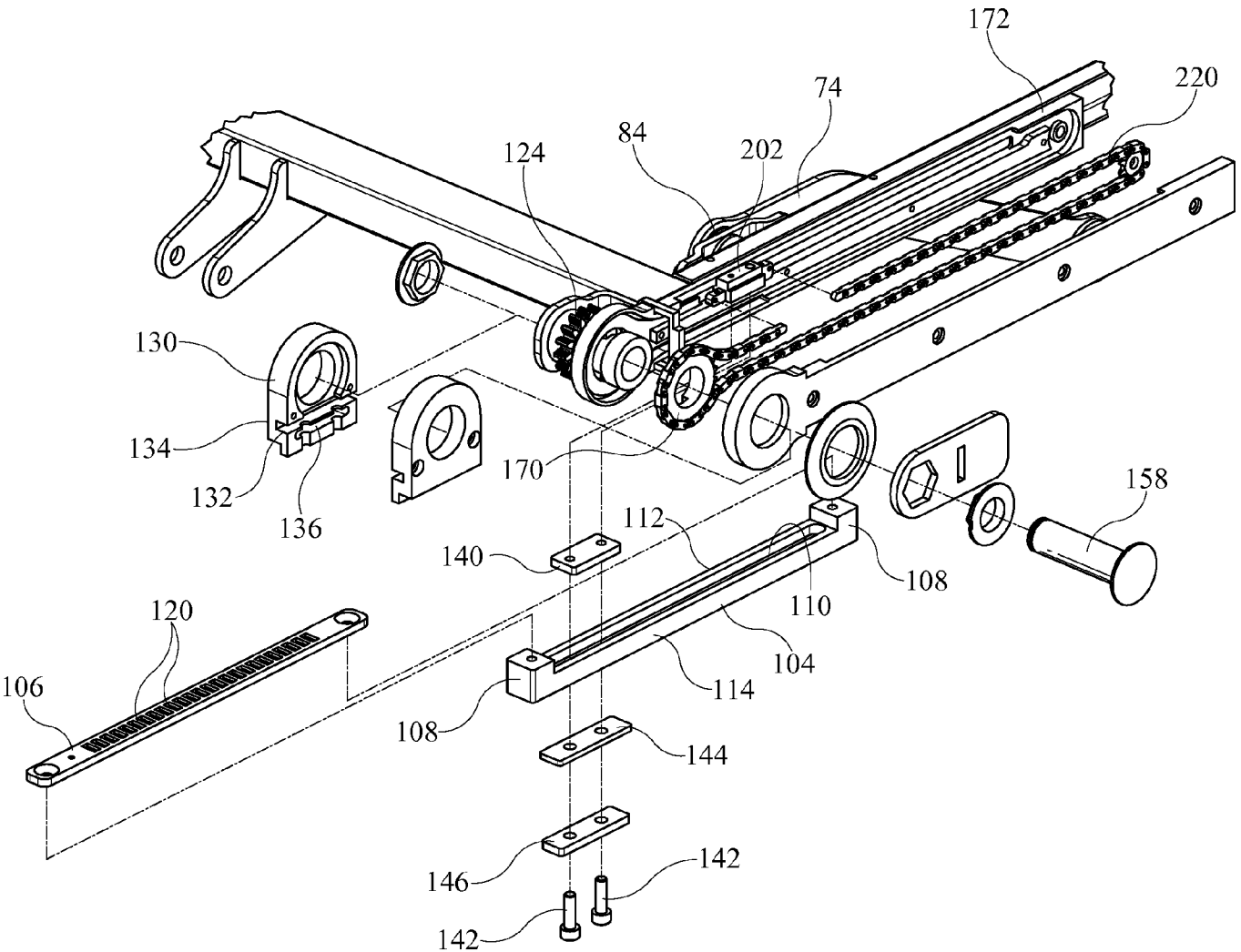

FIGS. 1-3 show a hospital bed 10 extending longitudinally from a head end 12 to a foot end 14 and laterally from a left side 16 to a right side 18. FIGS. 1-2 also show a longitudinally extending centerline 22. The bed structure includes a base frame 26 and an elevatable frame 28 connected to the base frame by folding links 30. The bed also includes four deck sections: upper body section 34, seat section 36, thigh section 38 and calf section 40, all connected to the elevatable frame. The upper body deck section 34 includes a framework 50 comprising left and right hollow rails 52, 54 joined to each other by an upper beam 56 and a lower beam 58. First and second rail slots 60, 62 penetrate through and extend part way along the top of each rail. The lower end of each rail also includes a two sided mounting bracket 64. The framework 50 is moveably connected to elevatable frame 28 so that the framework is longitudinally translatable relative to the elevatable frame and is also rotatable about pivot axis 70. Deck section 34 also includes a deck panel 72 (shown in phantom) moveably connected to the framework 50. In particular, panel 72 is translatable relative to the framework in directions P1, P2 parallel to the angular orientation α of the framework. This translation is the parallel translation referred to in the application summarized in the "Background" section of this application.

The bed also includes a pair of compression links 74 each having a frame end 76 pivotably connected to the elevatable frame at a frame joint 78 and a deck end 82 pivotably connected to the deck framework at a deck joint 84. In the embodiment illustrated in FIGS. 1-3 frame joint 78 is not translatable relative to the frame, however in an alternate embodiment (FIG. 15) joint 78 is longitudinally translatable relative to the frame.

The bed also includes a drive system which includes an actuator 90 having a deck end 92 connected to upper body deck framework 50 and a grounded end 94 connected to a suitable mechanical ground, such as elevatable frame 28. The drive system also includes a motion converter, indicated generally by reference numeral 100, for translating panel 72 relative to the deck framework in response to at least one of: a) relative translation between the deck framework and the frame, and b) relative rotation of the deck framework and the frame about axis 70. The illustrated embodiment includes both left and right motion converter units 100L, 100R. The units are mirror images of each other, hence it will suffice to describe only one of the units in more depth.

FIGS. 4-8 show components and construction of one of the motion converter units in more detail. The motion converter includes a gear rack 102 affixed to elevatable frame 28. Alternatively, the gear rack may be considered to be a part of the elevatable frame. The illustrated rack comprises a single piece slide rail 104 screwed to the frame and a rack plate 106 screwed to pedestals 108 at each end of the slide rail. A slot 110 extends along the slide rail between the pedestals. The slide rail has laterally inboard and outboard sides 112, 114 each with a shoulder 116. The rack plate includes openings 120 for receiving a gear tooth. The openings have a profile that conforms to the profile of the gear teeth.

The motion converter also includes a primary gear 124 in mesh with the rack plate. The gear has a stub shaft 126 extending laterally away from bed centerline 22. A pair of lugs 128 projects laterally from the shaft. A split gear housing 130 has a rectangularly shaped opening 132 extending through its base 134, a cavity 136 inside the base and a tail 138 projecting from the base. The tail nests snugly in slide rail slot 110, and the opening 132 embraces and fits snugly around rack plate 106. An internal plate 140 resides in the cavity. Screws 142 extend through a bearing plate 144 and a backing plate 146 and into the internal plate 140 to slidingly clamp the housing to the slide rail with the bearing plate abutting rail shoulder 116. The primary gear is rotatably mounted inside gear housing 130 by way of inboard and outboard gear bushings 154, 156 and a laterally extending pivot axle 158. The pivot axle also extends through holes 162 in the rail mounting bracket 64 to connect the primary gear to the deck framework. Bearings 164 nest in the holes 162 and circumscribe pivot axle 158.

Figure 9:
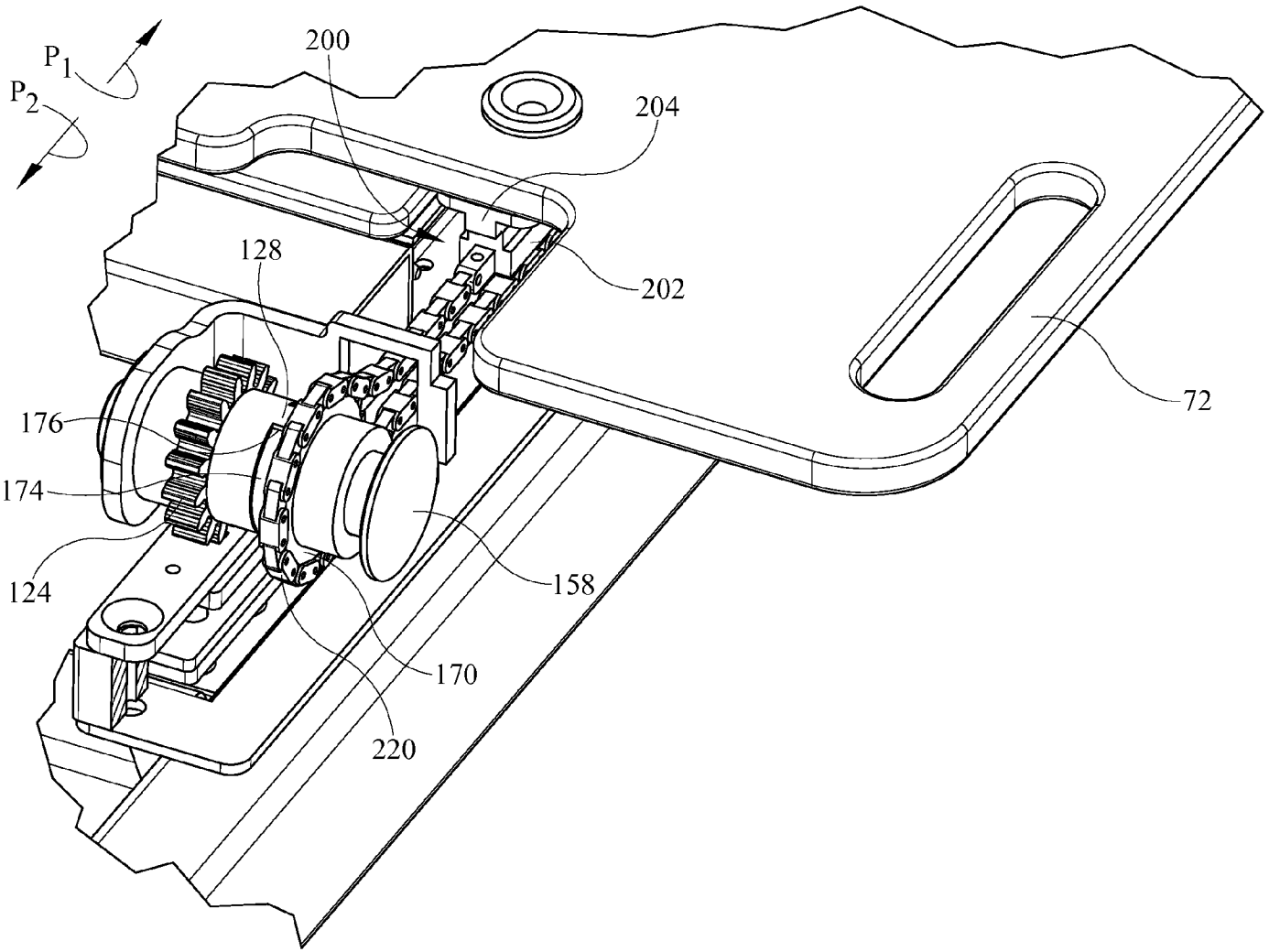
FIG. 9-10 are perspective views with selected components removed or broken away to reveal components such as a sprocket, the drive chain and a slider.
Figure 10:
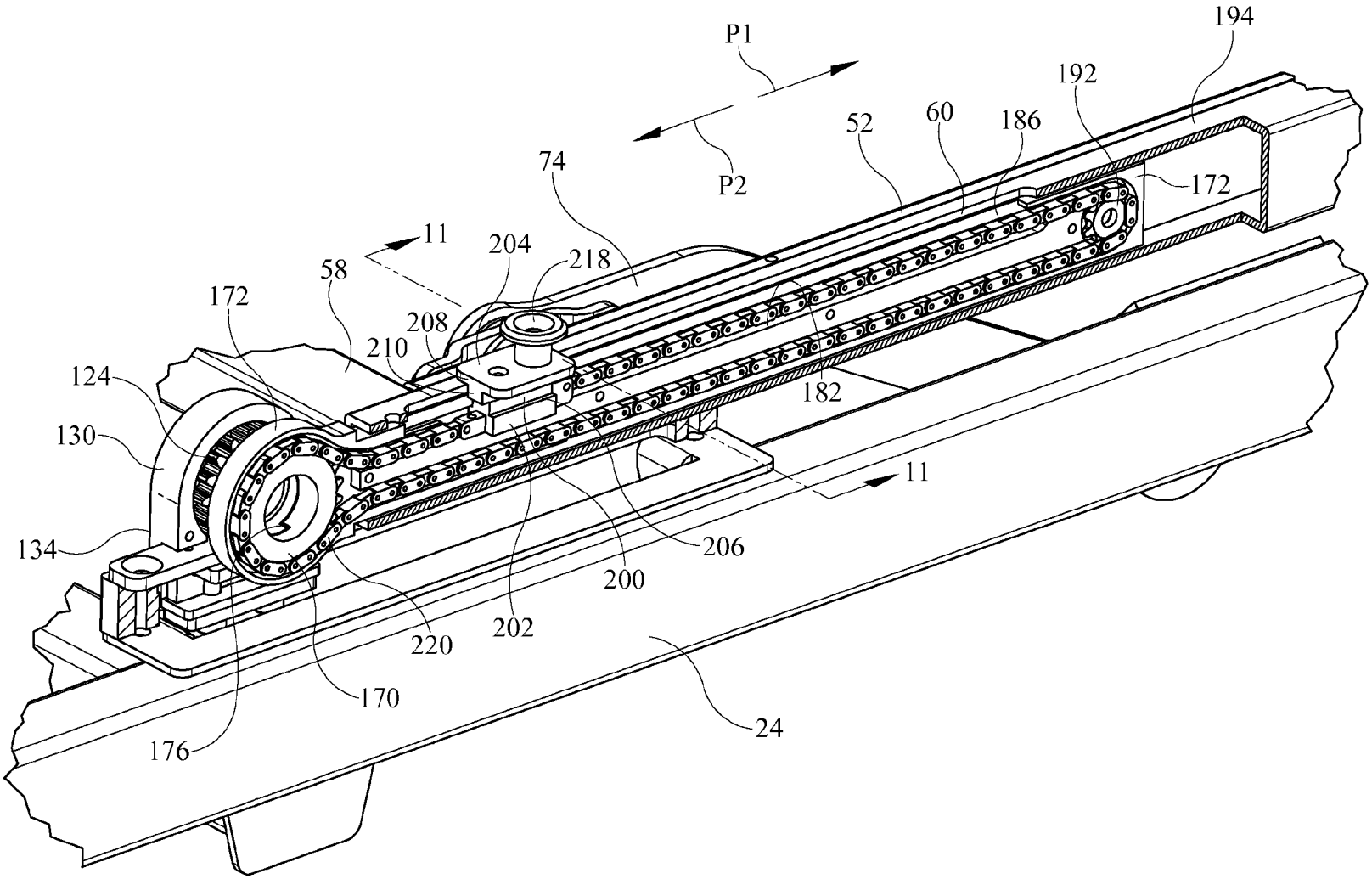
Figure 11:
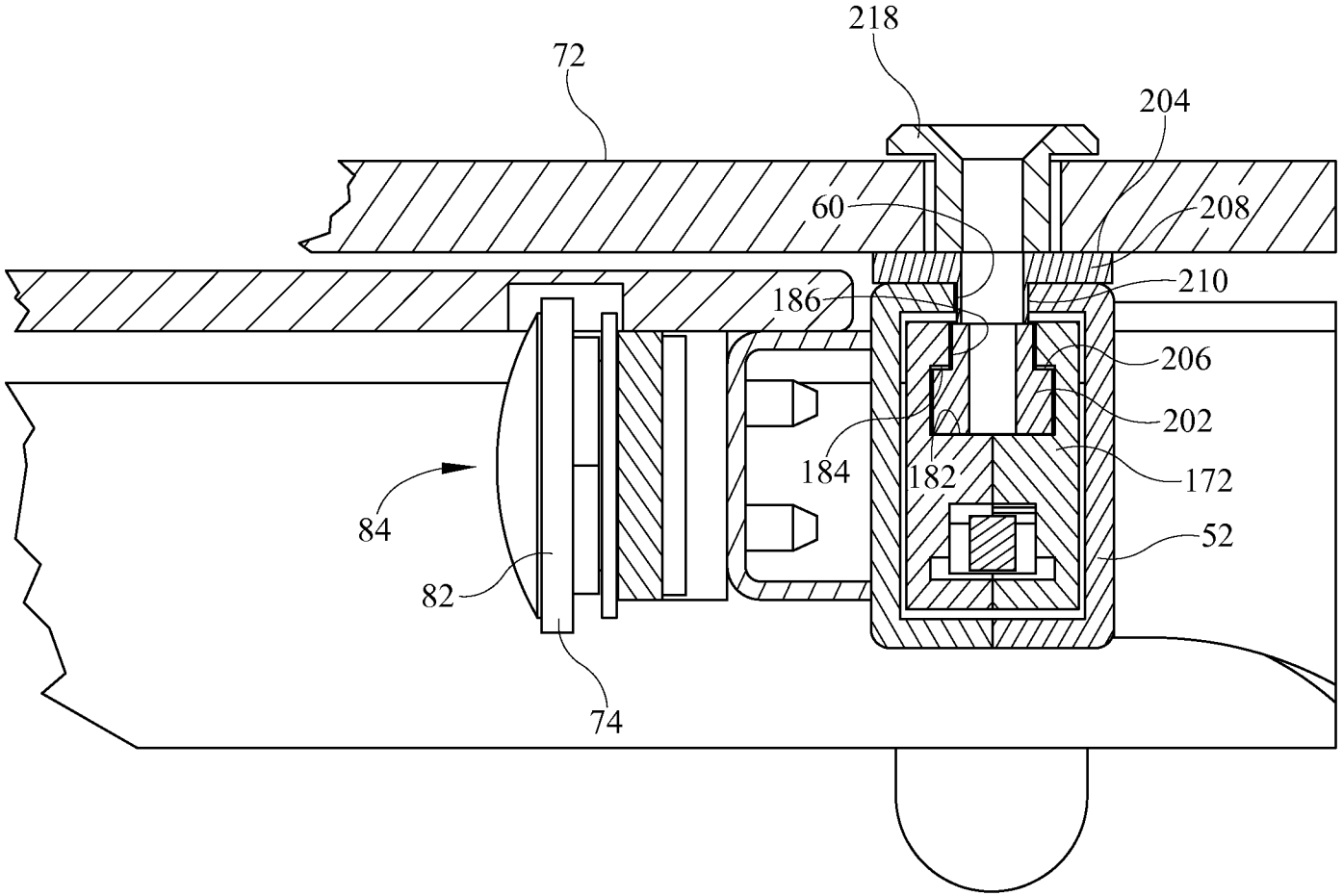
FIG. 11 is a cross sectional view taken in direction 11-11 of FIG. 10 showing the slider of FIGS. 9-10 in relation to a rail portion of the upper body deck section, a chain housing and a deck panel drive lug.

Referring additionally to FIGS. 9-11, The motion converter also includes a deck panel rotary drive element such as a panel drive sprocket 170. The sprocket resides inside a chain housing 172 located adjacent to and outboard of the gear housing 130. The sprocket is rotatably mounted on pivot axle 158 by way of outboard gear bushing 156. The sprocket has a stub shaft 174 extending laterally toward bed centerline 22. Notches 176 at the inboard tip of the stub shaft mate with lugs 128 on the primary gear stub shaft to rotatably connect the sprocket to the primary gear. The sprocket and the primary gear are thus coaxial and mutually corotatable. In the illustrated embodiment the pitch diameters of the primary gear and the sprocket are 37.0 and 42.6 mm respectively. Accordingly, the primary gear and sprocket exhibit a non-unity drive ratio, specifically a drive ratio of about 1.15.

The chain housing 172 extends into the hollow interior of the framework (i.e. into rail 52). The chain housing includes an internal track or ledge 182, a shoulder 184, and an elongated slot 186 that registers with first slot 60 in the framework rail. An idler sprocket 192 is rotatably mounted inside the chain housing at its remote end 194. Because the chain housing is stationary with respect to the deck framework 50, the idler can be considered to be mounted on the framework.

A slider 200 includes a slide link 202 translatably supported on housing internal track 182, and a slide block 204 bolted to the slide link. The slide link has a ledge 206 that abuts chain housing shoulder 184 to trap the slide link in the chain housing 172. The slide block includes a head portion 208 that overlies the top of framework rail 50 on either side of first rail slot 60 and a neck portion 210 that projects through the rail slot and extends to the slide link. The slider also includes a drive lug 218 projecting from the slide block. The drive lug is connected to deck panel 72, thereby connecting the slider to the panel.

Figure 12:
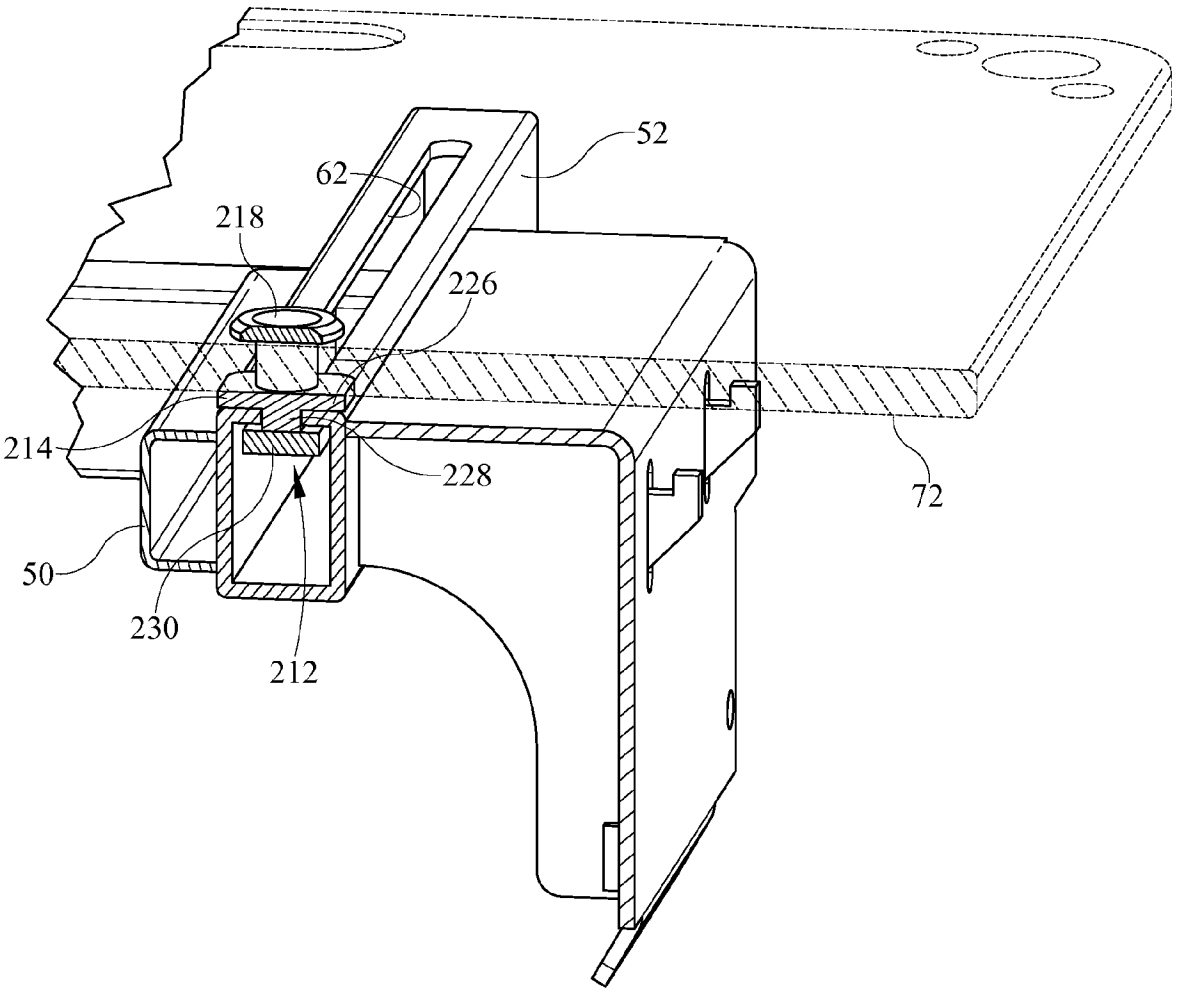
FIG. 12 is a perspective view showing a second slider in relation to the rail portion of the upper body deck section and a deck panel drive lug.

Referring to FIG. 12, a second slider 212 comprises a second slide block 214 having a head portion 226 and a neck portion 228. The second slider also includes a retainer plate 230. Head portion 226 of slide block 214 overlies the top of framework rail 52 on either side of second rail slot 62. Neck portion 228 projects through rail slot 62 and extends to the retainer plate. The slide block and retainer plate are bolted together so that the lateral sides of the retainer plate reside under the interior of framework rail 52 on either side of second rail slot 62 and so that the slider can slide longitudinally along the length of the slot. A drive lug 218 is connected to deck panel 72, thereby connecting the slider to the panel.

Figure 13:
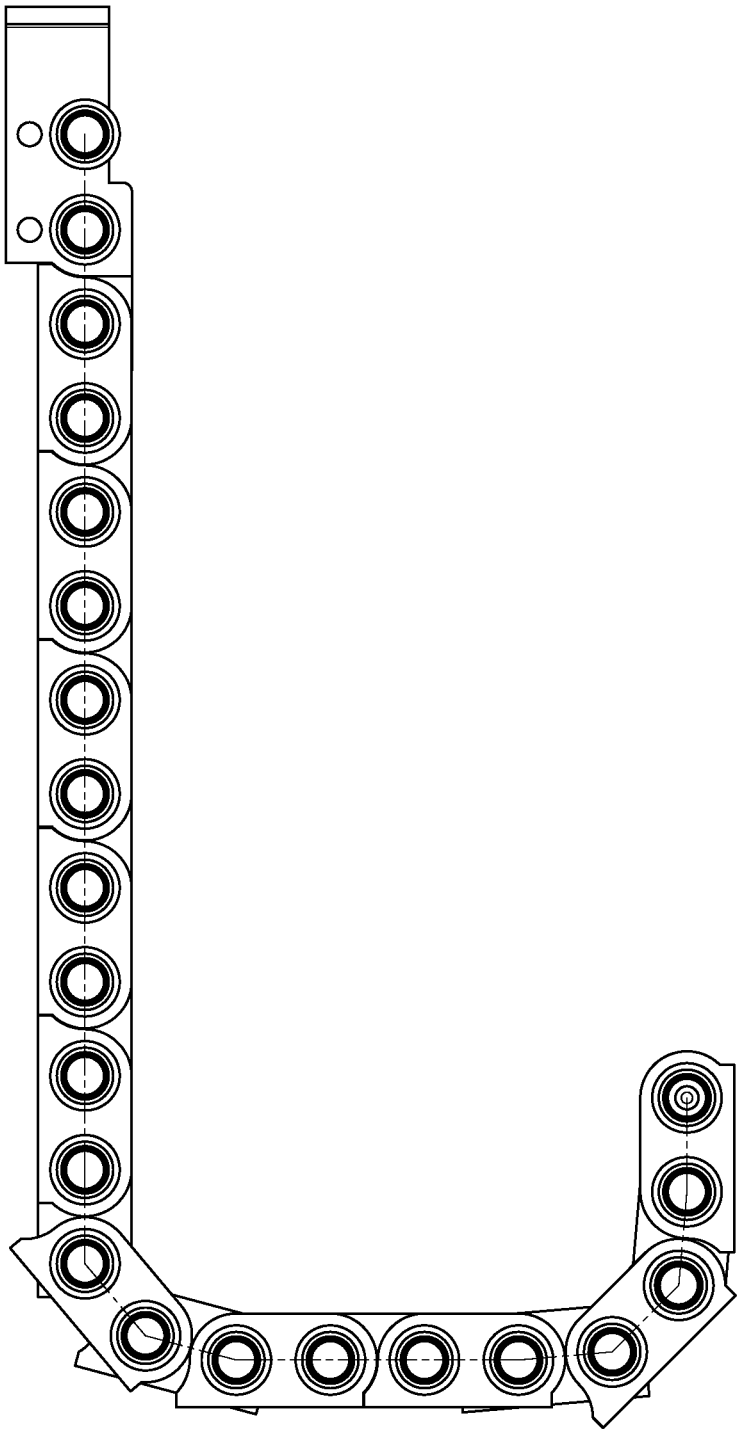
FIG. 13 is a side elevation view of a lift chain.

A roller chain 220, loops around each sprocket 170, 192 and engages with the sprocket teeth. The ends of the chain are connected to opposite ends of the slide link 202, thereby also connecting the chain to the deck panel 72. The chain is a linear or translatable drive element insofar as the part of the chain that extends linearly between the sprockets translates in direction P1 or P2 during operation of the drive system. Other kinematically equivalent devices could be used in lieu of roller chain 220. For example, a lift chain, one example of which is seen in FIG. 13, could serve as a translatable drive element.

By virtue of the sprockets 170, 192, chain 220 and slider 200, the primary gear is operatively connected to the deck panel 72.

In operation, actuator 90 extends and pushes framework beam 58 longitudinally toward the head end 12 of the bed. The compression link 74 rotates clockwise to change the angular orientation α of the upper body deck framework. The longitudinal translation of the framework relative to the elevatable frame causes primary gear 124 to rotate in a clockwise direction as seen in FIGS. 5, 8, 9 and 10. The primary gear drives the panel drive sprocket 170 in the same rotational sense. The sprocket drives the chain which acts on slider 200 to translate deck panel 72 in direction P1 relative to deck framework 50. Retraction of the actuator reverses the above described motion to translate the deck panel in direction P2.

During operation, the kinematic interaction between the gear rack 102 and the primary gear 124 serves as a means for converting the relative translation and/or rotation between the deck framework and the elevatable frame to a rotary motion of primary gear 124. The kinematic interaction between sprocket 170 and chain 220 serves as a means for converting the rotary motion to a translational motion. The slider 200 and lug 218 serve as a means for conveying the translational motion of the chain to the panel.

Figure 14:
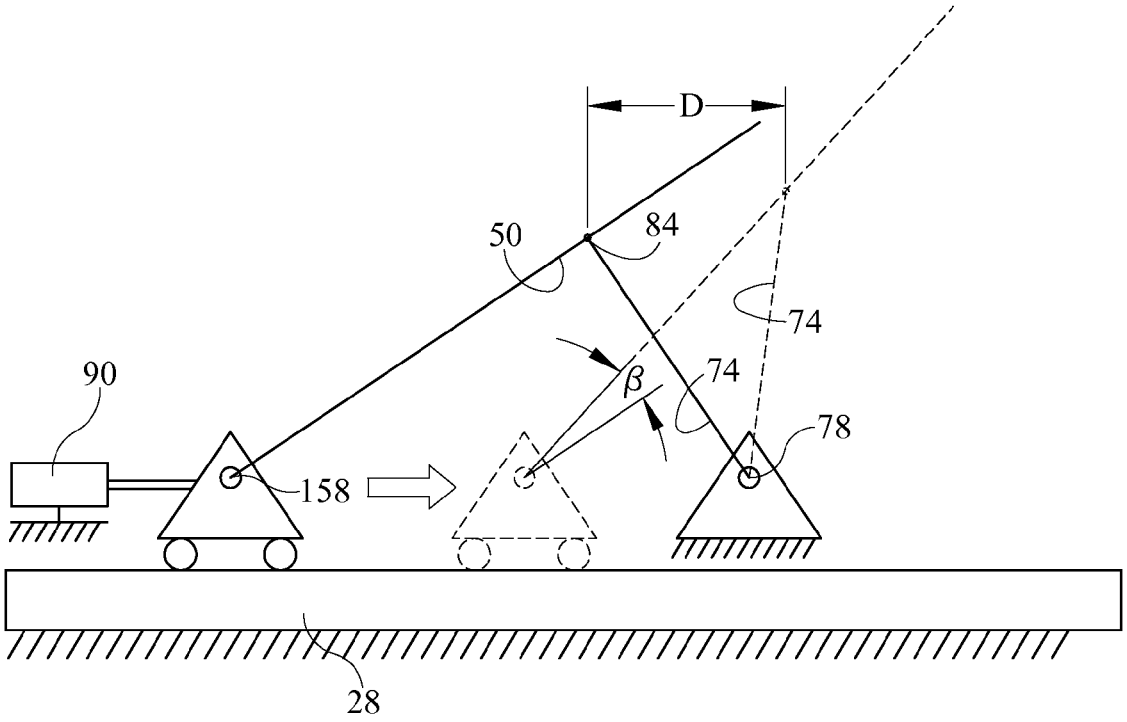
FIG. 14 is a schematic, side elevation view of a bed structure having a nontranslatable joint between a compression link and an elevatable frame of the bed.
Figure 15A:
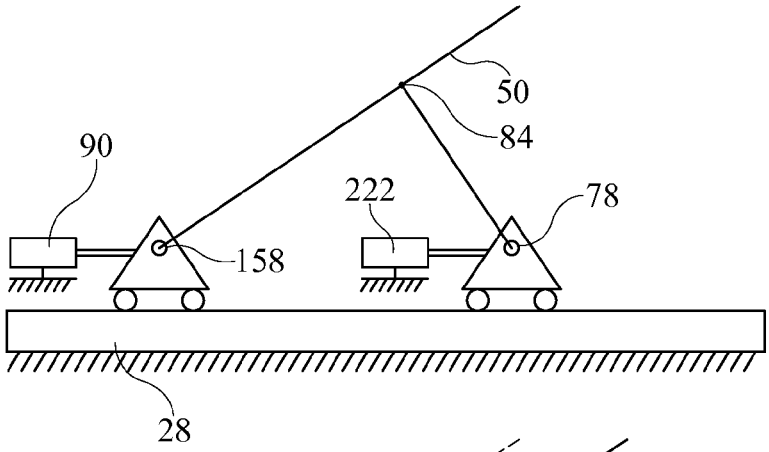
FIG. 15A-15D are views similar to that of FIG. 14 showing the results of various modes of motion in an embodiment in which the joint between the compression link and the elevatable frame is longitudinally translatable.
Figure 15B:
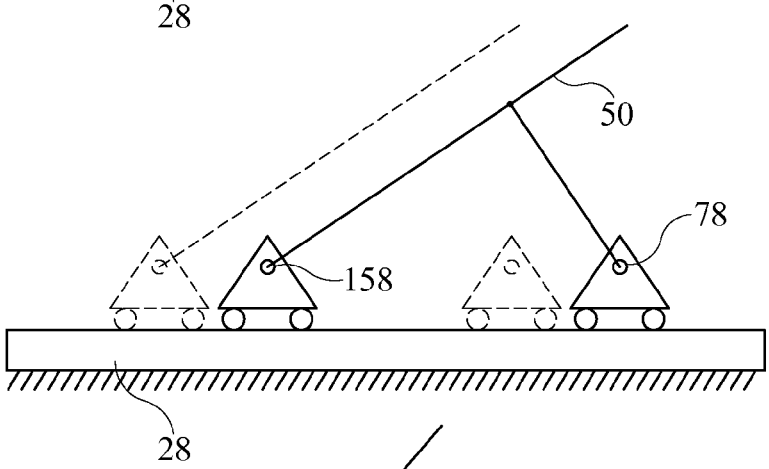
Figure 15C:
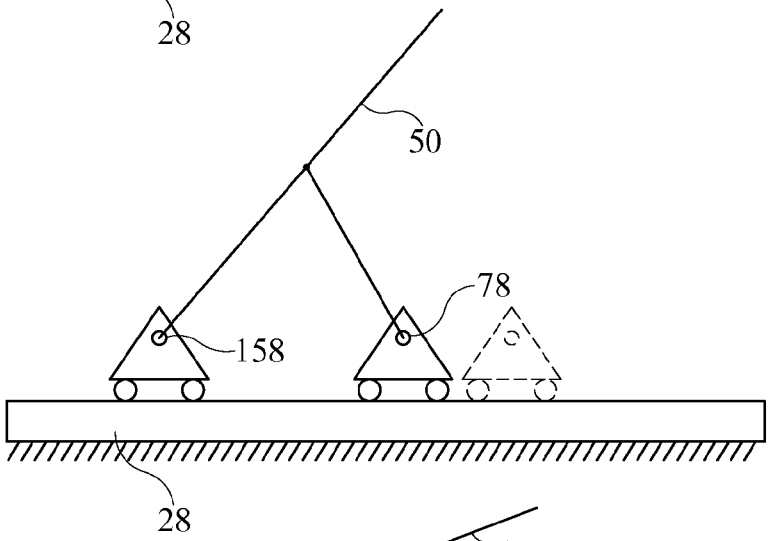
Figure 15D:
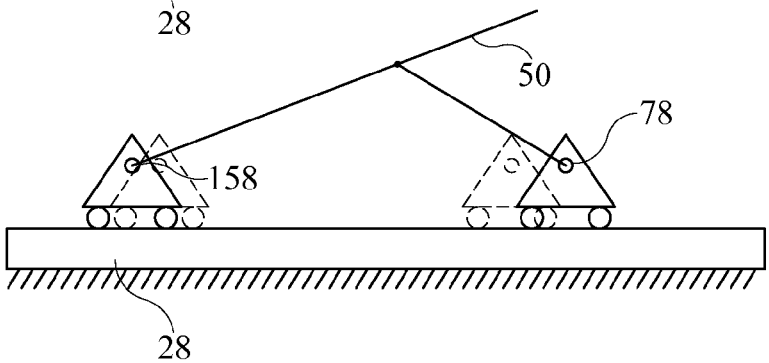

FIG. 14 is a simple schematic view showing the kinematic relationship of the actuator 90, elevatable frame 28, deck framework 50 and compression link 74 of the above described bed structure. Joint 78, as previously noted, is non-translatable relative to frame 28. As indicated in FIG. 14, operation of actuator 90 causes deck panel 72 to translate longitudinally relative to the elevatable frame by a distance D and to rotate relative to the elevatable frame through an angle β. In an alternative embodiment, seen in FIG. 15, joint 78 is longitudinally translatable relative to the frame by the action of second actuator 222. Depending on how the actions of actuators 90 and 222 are coordinated, deck framework 50 can be translated longitudinally relative to the elevatable frame 28 without any rotation of the framework (FIG. 15B) rotated relative to the elevatable frame without any translation (FIG. 15C) or rotated and translated as in the first embodiment (FIG. 15D). Although the inclusion of second actuator 222 introduces additional complexity, it also introduces additional flexibility that may be desirable. Because the motion converter described herein is responsive to relative motion between the frame and the deck framework irrespective of whether that relative motion is translation, rotation, or a combination thereof, it is equally applicable to the embodiments of both FIGS. 14 and 15.

It will be appreciated that kinematic equivalents of various components of the motion converter can be used in lieu of the illustrated components. For example belts and pulleys can be used instead of chain 220 and sprockets 170, 192; a notched or toothed belt and mating gears can also be substituted for the chain and sprockets; a roller and a track with a high coefficient of friction (to prevent roller skidding) might be substituted for the gear 124 and rack 102.

We claim:

1. A bed structure comprising:
a frame;
a deck framework moveably connected to the frame;
a panel moveably connected to the deck framework;
a rack affixed to the frame;
a primary gear meshing with the rack;
a panel rotary drive element driven by the primary gear; and
a panel translatable drive element engaged with the panel rotary drive element and connected to the panel for translating the panel relative to the deck framework in response to at least one of:
a) relative translation between the deck framework and the frame; and
b) relative rotation of the deck framework and the frame and wherein the panel rotary drive element is a panel drive sprocket and the panel translatable drive element is a chain.

2. The bed structure of claim 1 comprising:
an idler rotatably mounted to the deck framework;
a slider connected to the panel and the chain
the chain being engaged with the idler and the panel drive sprocket.

3. The bed structure of claim 1 comprising an actuator extending between the deck framework and a mechanical ground.

4. The bed structure of claim 3 wherein the frame serves as the mechanical ground.

5. The bed structure of claim 1 comprising a compression link pivotably connected to the frame and the deck framework.

6. The bed structure of claim 5 wherein the compression link is nontranslatably connected to the frame.

7. The bed structure of claim 1 comprising:
a) an idler sprocket rotatably mounted on the deck framework remote from the panel drive sprocket;
b) a slider connected to the panel; and
c) a chain engaged with the panel drive sprocket and the idler and connected to the slider
and wherein the primary gear is rotatably mounted on the deck framework.

8. A bed structure comprising:
a frame including a gear rack;
a deck framework pivotably and translatably connected to the frame;
a deck panel; and
a drive system comprising:
an actuator extending between the framework and a mechanical ground;
a primary gear rotatably connected to the deck framework and in mesh with the rack;
a panel rotary drive element corotatable with the primary gear; and
a linear drive element engaged with the panel rotary drive element and connected to the panel.

9. The bed structure of claim 8 wherein the panel rotary drive element is a sprocket and the linear drive element is a chain.

10. In a bed having a frame, a deck framework mounted rotatably and translatably relative to the frame and a panel translatable relative to the framework, a method for governing translational motion of the panel, the method comprising:
converting relative motion between the deck framework and the frame into a rotary motion of the primary drive element;
converting the rotary motion of the primary drive element to a translational motion; and
conveying the translational motion to the panel.

11. The method of claim 10 wherein the relative motion is exclusively a relative translation.

12. The method of claim 10 wherein the relative motion is exclusively a relative rotation.

13. A bed structure comprising:
a frame;
a deck framework moveably connected to the frame;
a panel moveably connected to the deck framework; and
a motion converter for translating the panel relative to the deck framework in response to relative translation between the deck framework and the frame.

14. The bed structure of claim 13 wherein the motion converter comprises:
a rack affixed to the frame; and
a primary gear meshing with the rack and operatively connected to the panel.

15. The bed structure of claim 14 wherein the motion converter comprises:
a panel rotary drive element driven by the primary gear; and
a panel translatable drive element connected to the panel and engaged with the panel rotary drive element.

16. The bed structure of claim 15 wherein the panel rotary drive element is a panel drive sprocket and the panel translatable drive element is a chain.

17. The bed structure of claim 16 comprising:

an idler rotatably mounted to the deck framework;

a chain, engaged with the idler and the panel drive sprocket; and a slider connected to the panel and the chain.

18. The bed structure of claim 13 comprising an actuator extending between the deck framework and a mechanical ground.

19. The bed structure of claim 18 wherein the frame serves as the mechanical ground.

20. The bed structure of claim 13 comprising a compression link pivotably connected to the frame and the deck framework.

21. The bed structure of claim 20 wherein the compression link is nontranslatably connected to the frame.

22. The bed structure of claim 13 wherein the motion converter comprises:

a) a rack secured to the frame;

b) a primary gear rotatably mounted on the deck framework and in mesh with the rack;

c) a panel drive sprocket rotatably mounted on the deck framework coaxially with the primary gear;

d) an idler sprocket rotatably mounted on the deck framework remote from the panel drive sprocket;

e) a slider connected to the panel; and f) a chain engaged with the panel drive sprocket and the idler and connected to the slider.

23. The bed structure of claim 13 comprising:

means for converting the relative translation and/or rotation to a rotary motion;

means for converting the rotary motion to a translational motion; and means for conveying the translational motion to the panel.

24. A bed structure comprising:

a frame;

a deck framework moveably connected to the frame;

a compression link pivotably connected between the frame and the deck framework;

a panel moveably connected to the deck framework; and a motion converter for translating the panel relative to the deck framework in response to at least one of:

a) relative translation between the deck framework and the frame; and b) relative rotation of the deck framework and the frame.

25. The bed structure of claim 24 wherein the compression link is nontranslatably connected to the frame.

26. A bed structure comprising:

a frame;

a deck framework moveably connected to the frame;

a panel moveably connected to the deck framework; and a motion converter for translating the panel relative to the deck framework in response to relative translation between the deck framework and the frame, the motion converter comprising:

a) a rack secured to the frame;

b) a primary gear rotatably mounted on the deck framework and in mesh with the rack;

c) a panel drive sprocket rotatably mounted on the deck framework coaxially with the primary gear;

d) an idler sprocket rotatably mounted on the deck framework remote from the panel drive sprocket;

e) a slider connected to the panel; and f) a chain engaged with the panel drive sprocket and the idler and connected to the slider.

* * * * *